US007264476B1

(12) United States Patent
Klodt

(10) Patent No.: US 7,264,476 B1
(45) Date of Patent: Sep. 4, 2007

(54) MAGNETIC TEACHING AID WITH REPLACEABLE NAME TAG

(76) Inventor: Nancy Klodt, 12708 - 160th Ave., Ottumwa, IA (US) 52501

( * ) Notice: Subject to any disclaimer, the term of this patent is extended or adjusted under 35 U.S.C. 154(b) by 83 days.

(21) Appl. No.: 10/727,203

(22) Filed: Dec. 3, 2003

(51) Int. Cl.
*G09B 19/00* (2006.01)

(52) U.S. Cl. ..... 434/365; 434/428; 434/430; 434/432; 40/122; 40/654.01; 40/661; 40/661.01

(58) Field of Classification Search ..... 434/365, 434/236, 237, 238, 432, 430, 168, 429, 370; 40/621, 661.01, 358, 122, 654.01, 661
See application file for complete search history.

(56) References Cited

U.S. PATENT DOCUMENTS

| | | | | | |
|---|---|---|---|---|---|
| 1,394,620 | A | * | 10/1921 | Haupt | 434/167 |
| 3,150,296 | A | * | 9/1964 | McIntosh | 335/285 |
| 3,187,449 | A | * | 6/1965 | Longo et al. | 40/661.01 |
| 3,469,325 | A | * | 9/1969 | Greenberg | 434/167 |
| 4,310,978 | A | * | 1/1982 | Stern | 40/600 |
| 4,461,107 | A | * | 7/1984 | Grate | 40/576 |
| 4,776,799 | A | * | 10/1988 | Walsh | 434/238 |
| 4,793,634 | A | * | 12/1988 | Alloggiamento | 283/2 |
| 4,952,153 | A | * | 8/1990 | McAllister | 434/259 |
| 5,347,733 | A | | 9/1994 | Whittington | |
| 5,533,902 | A | * | 7/1996 | Miller | 434/112 |
| 5,707,238 | A | | 1/1998 | Bush | |
| 5,725,381 | A | * | 3/1998 | Kollath et al. | 434/238 |
| 6,182,387 | B1 | * | 2/2001 | Duguay | 40/621 |
| 6,224,381 | B1 | | 5/2001 | Culberson et al. | |
| 6,238,216 | B1 | | 5/2001 | Menelly | |
| 6,336,555 | B1 | | 1/2002 | Breeden | |
| 6,419,495 | B1 | * | 7/2002 | Lehmkuhl | 434/238 |
| 6,572,380 | B1 | * | 6/2003 | Buckley et al. | 434/238 |
| 2004/0262185 | A1 | * | 12/2004 | Mills | 206/483 |

* cited by examiner

*Primary Examiner*—Dmitry Suhol
(74) *Attorney, Agent, or Firm*—McKee, Voorhees & Sease, P.L.C.

(57) ABSTRACT

A desktop teaching aid which has a body having a top surface and an opposite bottom surface, the bottom surface comprising a magnetic material for securing the body to a desk, the body defining a frame around an aperture, educational information represented on the top surface of the body, and a replaceable name tag positioned within the aperture of the body.

8 Claims, 3 Drawing Sheets

MAGNETIC TEACHING AID WITH REPLACEABLE NAME TAG

BACKGROUND OF THE INVENTION

The present invention relates to a teaching aid. More particularly, although not exclusively, the present invention relates to a magnetic teaching aid that can hold a name tag.

Teachers have found that teaching aids that can be placed on a desk are helpful. There are laminated desktop teaching aids and self-adhesive plastic desktop teaching aids available through various vendors.

Yet problems remain with such teaching aids in that only a limited amount of educational material can be place on a teaching aid.

Another problem with such teaching aids, is that with a plain laminated desktop teaching aid the teaching aid is not secured to the desk and therefore can cause a distraction for the student. There are also problems with the self-adhesive teaching aids in that custodians may not like teachers using tape or adhesives because it can leave a residue on the desk and sometimes pull off the paint.

Also, it is known that teachers use name tags that can be taped or adhered to a desk with their own educational material on a name tag to aid the student. This system creates the same problem in that the tape or adhesive leaves a residue and can pull off the paint. Therefore, problems remain in the art.

Thus, it is a primary object, feature, or advantage of the present invention to improve upon the state of the art.

It is a further object, feature, or advantage of the present invention to provide a teaching aid that can be secured to a desk.

It is a further object, feature, or advantage of the present invention to provide a teaching aid that does not use tape or adhesive to secure the teaching aid to a desk.

It is a further object, feature, or advantage of the present invention to provide a teaching aid that allows teachers to replace or update educational material associated with the teaching aid.

These and/or other object, feature, or advantage of the present invention will become apparent from the Specification and claims.

SUMMARY OF THE INVENTION

The invention is a teaching aid. In one aspect of the invention, the teaching aid includes a body that has a top surface and an opposite bottom surface. The bottom surface includes a magnet for attaching to a metal surface such as a desk or locker. The body defines a frame around an aperture. Within the aperture, a replaceable name tag is positioned. There is educational information represented on the top surface of the body. In addition, educational information can also be placed on the replaceable name tag.

The present invention provides the advantage of allowing a teacher to easily modify the educational material used on a desktop. In addition, the present invention allows the teaching aid to be removed from the desktop without causing damage to the desktop.

DETAILED DESCRIPTION OF THE PREFERRED EMBODIMENT

Figure 1:
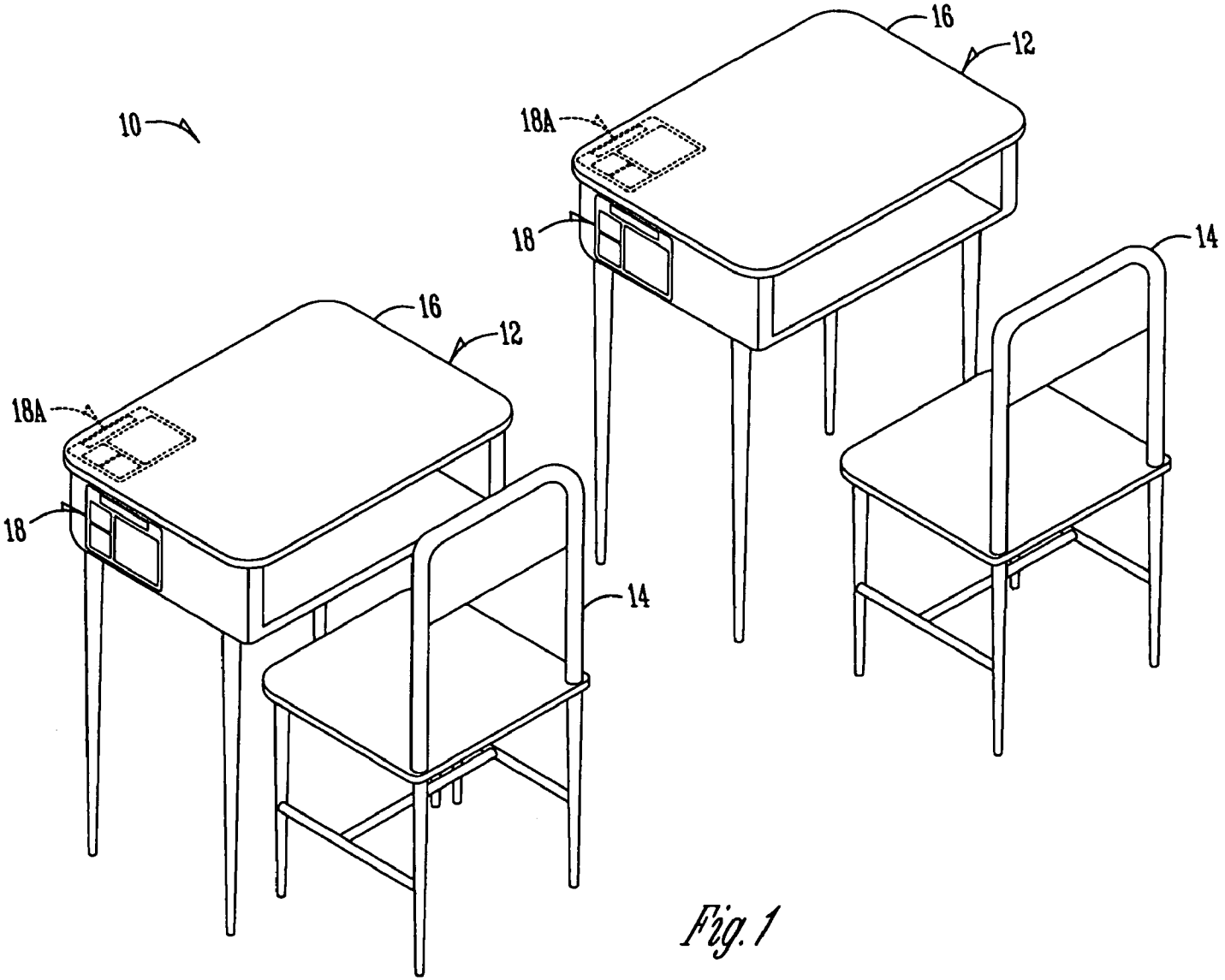
FIG. 1 is a pictorial representation of a classroom with multiple desks.

The present invention is a new teaching aid that can be used in the classroom environment. FIG. 1 illustrates a classroom 10 in which the invention can be used. Within the classroom 10 are plurality of desks 12 for students. There is also a chair 14 associated with each desk 12. A top surface 16 of each desk is shown. The top surface 16 is usually metallic in nature. Attached to a side surface of each desk 12 is one embodiment of a teaching aid 18 according to the present invention. The teaching aid 18 includes a body 20. The body 20 at least partially surrounds or defines a hole or aperture 22. The body 20 has a front surface 21 and an opposite rear surface (see FIG. 3). On the front surface 21 of the body 20 there are a plurality of regions such as region 24, region 26, and region 28. Within each region is educational material that serves as a teaching aid. In the embodiment shown in FIG. 2, the teaching material shown in regions 24, 26, and 28 is permanent in nature such as if this information was printed on the front or top surface 21 of the body 20. In addition to the educational material, the present invention contemplates that one or more design elements 30 may be present on the top surface of the body 20. In hidden lines, the teaching aid 18A is also shown on the top surface 16 of each desk 12.

Figure 2:
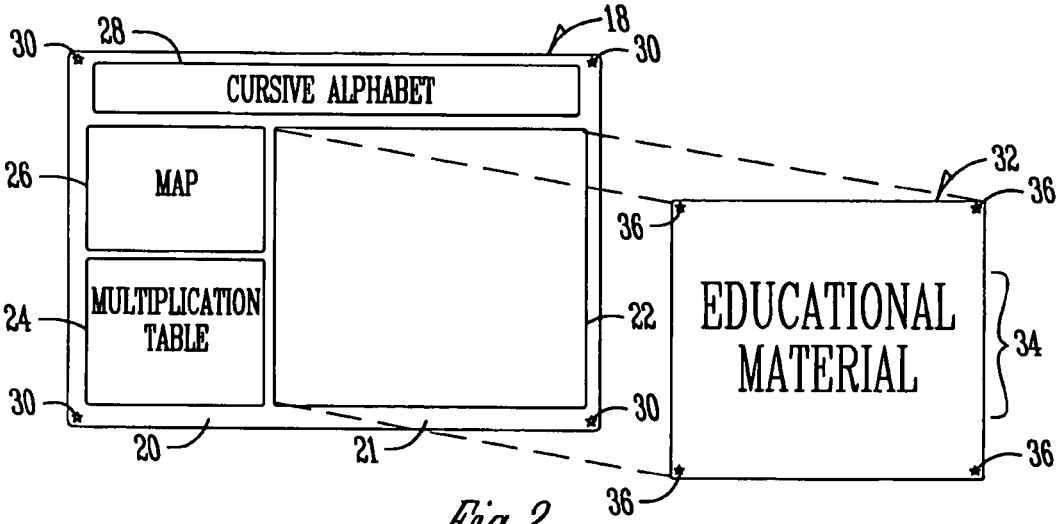
FIG. 2 is a top view of one embodiment of a teaching aid according to the present invention.

In FIG. 2, a name tag 32 is shown. The name tag is preferably of the kind sold as a label or name tag, but other types of paper medium standardized or non-standardized sizes can be used, including note cards. Thus, such a paper medium can be a "name tag" even though it is not necessarily sold as such. The name tag 32 can include a student name or can include educational material 34. The educational material 34 can relate to any number of subjects that a student is exposed to. Subjects can include reading, writing, mathematics, science, geography, and other subjects. Also shown on the name tag 32 is a plurality of design elements 36. In the embodiment of FIG. 2, the design elements 36 correspond to, match, or otherwise are associated with the design elements 30 on the body 20 of the teaching aid 18. The matching of the design elements 36 and 30 make the teaching aid more universally appealing to students which hopefully increases the effectiveness of the teaching aid.

The name tag 32 is positioned so that the aperture 22 in the body 20 frames the name tag 32. This provides a teacher a number of advantages. The teacher can replace the name tag 32 throughout the school year with different educational materials. This greatly enhances the value of a desktop teaching aid as a learning tool. The present invention contemplates a teacher can make their own name tags 32 by writing or printing educational material on a blank name tag. The blank name tag may come with design elements 36 already on it. It is also noted that, because the name tag is placed within the body 20, the name tag 32 does not develop "dog-ears" that would be present if it was adhered to a desk.

Figure 3:
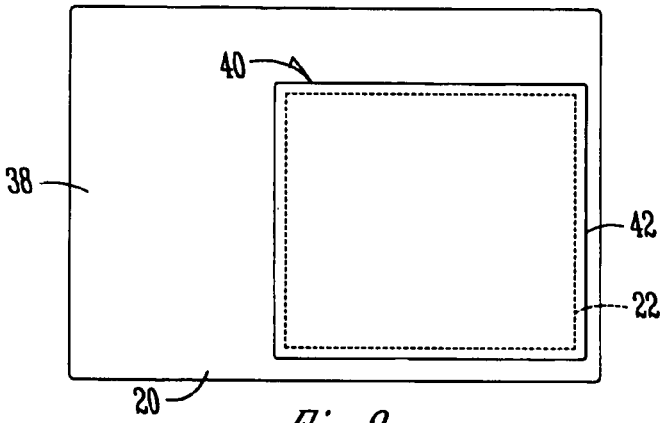
FIG. 3 is a bottom view of one embodiment of a teaching aid according to the present invention.

FIG. 3 illustrates one manner in which the name tag 32 can be secured to the body 20 of the teaching aid 18. In FIG. 3, the bottom surface 38 of the body 20 is shown. Operatively connected to the bottom surface 38 is a sleeve 40 that is adapted to accept a name tag 32. The sleeve 40 includes an opening 42 in which the name tag 32 can be inserted. The sleeve 40 can be operatively connected to the body 20 in various ways, including through adhesives, through stitching, or through other types of fastening. The sleeve 40 shown provides the additional benefit of protecting the name tag 32 in addition to holding the name tag 32. The invention contemplates, however, that a sleeve 40 need not be used and alternative means for securing the name tag 32 can be used, including by providing one or more slots for holding the name tag 32.

Figure 4:
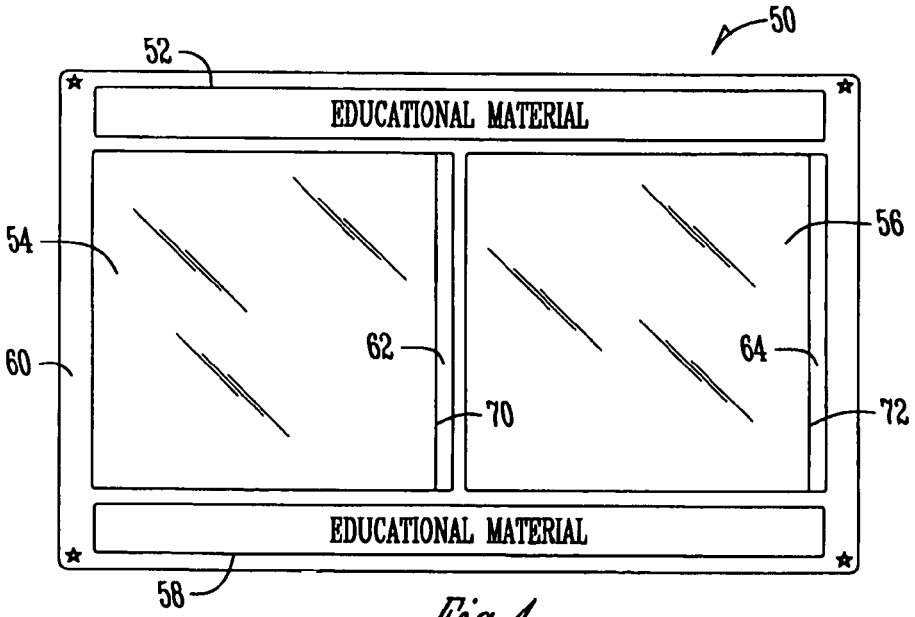
FIG. 4 is a top view of another embodiment of a teaching aid of the present invention.

FIG. 4 illustrates another embodiment of a teaching aid 50 of the present invention. The teaching aid 50 in FIG. 4 includes a body 56 and has regions 52 and 58 for permanent educational material. In addition, there are pockets 54 and 56 for holding name tags. In this embodiment, multiple name tags can be used at the same time. The pocket or sleeve 54 has an opening 62 for insertion of a name tag. The pocket 56 has an opening 64 for insertion of a name tag. The top surface 70 of the pocket 54 and the top surface 72 of the pocket or sleeve 56 are both preferably of a transparent material so that the educational material on a name tag can be clearly seen. As shown in FIG. 4, the name tags can be inserted from the top of the teaching aid 18. When configured in this fashion, the body 60 need not have an aperture such as the aperture 22 in the embodiment shown in FIG. 2.

Figure 5:
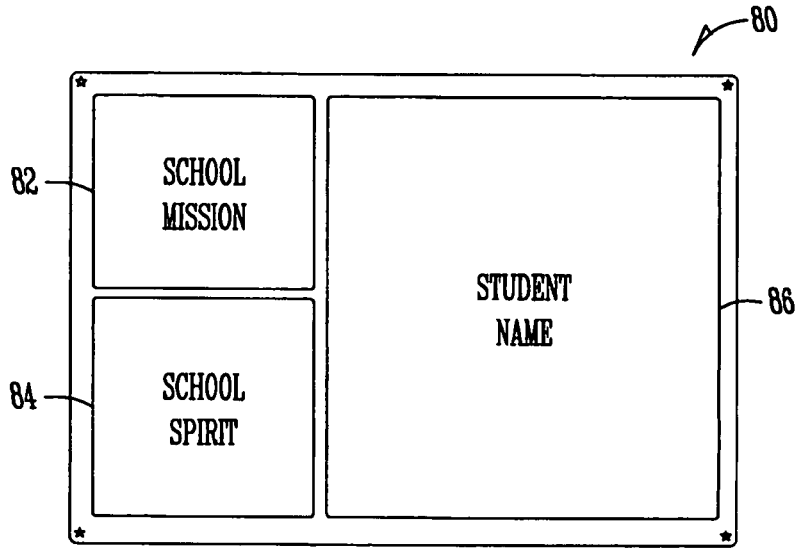
FIG. 5 is a top view of another embodiment of the present invention.
Figure 6:
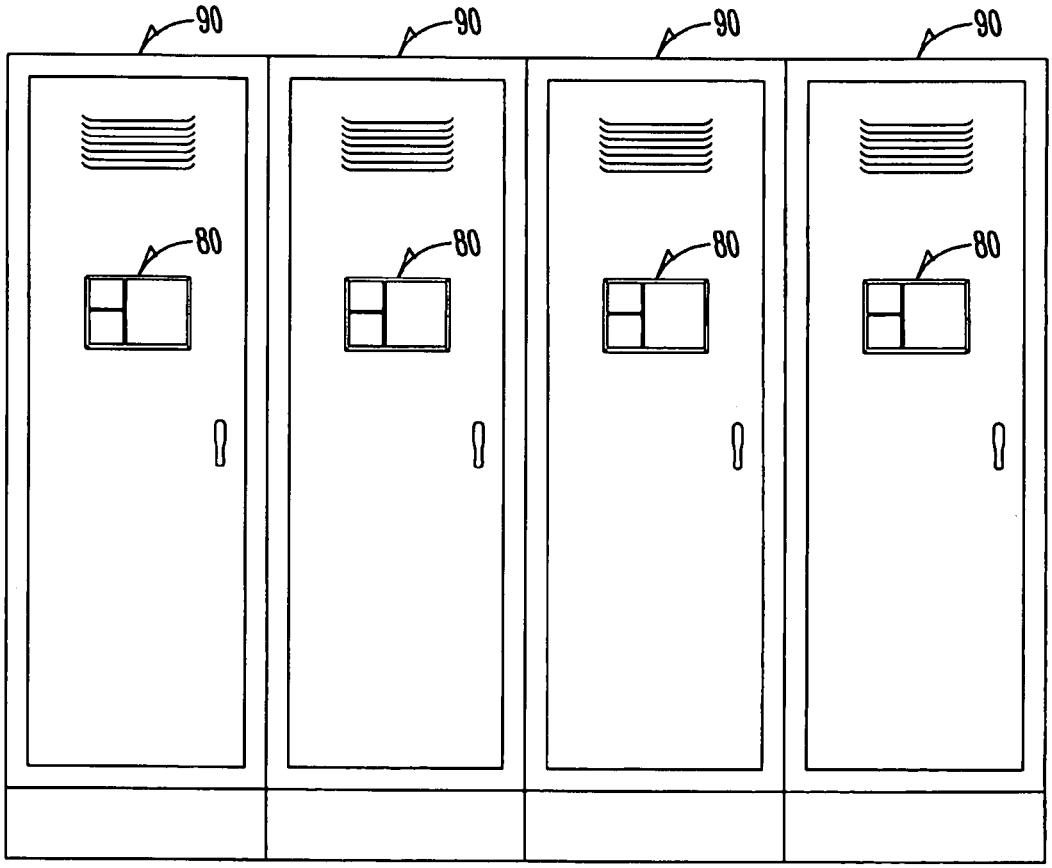
FIG. 6 is a pictorial representation of a row of lockers using the present invention.

FIG. 5 illustrates another embodiment of the present invention. In FIG. 5, a name tag holder 80 is shown. The name tag holder includes a name tag 86 with a student name. In addition instead of teaching information, there is school mission information 82 and school spirit information 84. The name tag holder 80 is also magnetic in nature. It can be used on a metal locker 90 as shown in FIG. 6, where the name tag holder 80 includes a design, the design including a school name, mascot, or logo.

Also, it is to be understood that the present invention contemplates numerous variations in the shapes, types of material, specific types of educational material, manner in which the name tag is secured, and the design of the name tag used. These and other variations are all within the spirit and scope of the invention.

What is claimed is:

1. A desktop teaching aid for presenting educational material to a student, comprising:

a desktop teaching aid body having a top surface and an opposite bottom surface, the bottom surface comprising a magnetic material for securing the body to a desk;

the body defining a frame around an aperture through the body;

educational information represented on the top surface of the body;

a replaceable name tag comprising a paper medium, the replaceable name tag positioned within the aperture of the body such that the desktop teaching aid is reconfigurable by replacement of the replaceable name tag to thereby (a) identify a different student by name where the replaceable name tag includes a student name, or (b) present different educational information where the replaceable name tag includes educational information;

the replaceable name tag having a first surface and an opposite second surface, the educational information presented on the second surface and the second surface being viewable when the desktop teaching aid body secured to the desk with the magnetic material;

a sleeve attached to the bottom surface of the body along the frame, the sleeve securing the replaceable name tag in place substantially behind the aperture in the frame; and the sleeve having an opening along the frame adapted for inserting the replaceable name tag behind the aperture in the frame.

2. The teaching aid of claim 1 wherein the educational material is selected from a set consisting of mathematics material, geography material, and reading material.

3. The teaching aid of claim 1 wherein both the top surface of the body and the replaceable name tag include decorative designs and wherein the decorative design of the top surface of the body matches the decorative design of the replaceable name tag.

4. The teaching aid of claim 1 wherein the replaceable name tag includes educational material.

5. The teaching aid of claim 1 wherein the replaceable name tag includes educational information.

6. The teaching aid of claim 1 wherein the educational material is located in a plurality of regions of the body.

7. A desktop teaching aid for presenting educational material to a student, comprising:

a body having a top surface and an opposite bottom surface, the bottom surface comprising a magnetic material for magnetically securing the body to a desk;

a first region of permanent educational material disposed on the top surface of the body;

a second region of permanent educational material disposed on the top surface of the body;

a plurality of replaceable name tags, each comprising a paper medium, each replaceable name tag having a first surface and an opposite second surface, the second surface presenting educational information and being viewable when the teaching device is secured to the desk with the magnetic material;

a first replaceable name tag region on the body adapted for removably securing one of the replaceable name tags to the body;

the replaceable name tag region below the first region of permanent educational material and above the second region of permanent educational material;

each of the replaceable name tags including additional educational material such that the desktop teaching aid is reconfigurable by replacement of one of the replaceable name tags;

a first transparent sleeve attached to the top surface of the body for securing one of the replacement name tags to the body wherein the sleeve covers said replaceable name tag while displaying and protecting the second surface of said name tag; and the first transparent sleeve having an opening for inserting said replaceable name tag;

a second replaceable name tag region for removably securing one of the plurality of replaceable name tags to the body;

the second replaceable name tag region below the first region of permanent educational material and above the second region of permanent educational material;

a second transparent sleeve attached to the top surface of the body for holding one of the plurality of replaceable name tags;

the second transparent sleeve having an opening for inserting one of the replaceable name tags.

8. The desktop teaching aid of claim 7 wherein the body includes at least one decorative design element and the replaceable name tag includes at least one matching decorative design elements.

* * * * *